US005209124A

United States Patent [19]

Graudejus et al.

[11] Patent Number: 5,209,124

[45] Date of Patent: May 11, 1993

[54] METHOD AND APPARATUS FOR DETERMINING THE FILLING CAPACITY OF TOBACCO AND THE HARDNESS OF CIGARETTES

[75] Inventors: Wolfgang Graudejus, Haselau; Martin Rattemeyer, both of Hamburg, Fed. Rep. of Germany

[73] Assignee: H.F. & Ph.F. Reemtsma GmbH & Co., Hamburg, Fed. Rep. of Germany

[21] Appl. No.: 571,976

[22] Filed: Aug. 24, 1990

[30] Foreign Application Priority Data

Sep. 2, 1989 [DE] Fed. Rep. of Germany ..... 3929155

[51] Int. Cl.[5] ..... G01N 3/08

[52] U.S. Cl. ..... 73/821; 73/78

[58] Field of Search ..... 73/821, 818, 78, 823, 73/825

[56] References Cited

U.S. PATENT DOCUMENTS

| | | | |
|---|---|---|---|
| 3,115,772 | 12/1963 | O'Keeffe et al. | 73/94 |
| 3,524,344 | 8/1970 | Converse, III et al. | 73/118.1 |
| 3,641,734 | 2/1972 | Fishburne | 53/124 |
| 4,448,079 | 5/1984 | Schumacher et al. | 73/78 X |

FOREIGN PATENT DOCUMENTS

| | | |
|---|---|---|
| 1432587 | 11/1968 | Fed. Rep. of Germany . |
| 1573080 | 4/1972 | Fed. Rep. of Germany . |
| 8223662.3 | 1/1984 | Fed. Rep. of Germany . |
| 3432839 | 3/1986 | Fed. Rep. of Germany . |

OTHER PUBLICATIONS

"Untersuchungen mit einem . . . Fullfahighheit . . . " von Lorenz et al., Beitraege zur Tabakforschung, vol. 4, Issue 7, (1968).

*Primary Examiner*—Jerry W. Myracle

*Attorney, Agent, or Firm*—Nixon & Vanderhye

[57] ABSTRACT

A method and an apparatus for the determination of the filling capacity of tobacco and the hardness of cigarettes includes a container containing tobacco compressed by a test plunger driven in a pre-set manner by a motor, such that the force exerted on the tobacco is measured and passed to a computer. The length of the tobacco column is also measured. After the compression movement of the test plunger and while it rests in its end position for a relaxation period, the force acting on the tobacco is measured at pre-set time intervals and signals indicative thereof are passed on to the computer. The temperature and the moisture of the tobacco are determined, enabling the measured values to be adjusted to reflect standard conditions. The apparatus for determining the hardness of cigarettes differs from the apparatus for the determination of the filling capacity of tobacco only in the construction of the test plunger and the sample holder.

17 Claims, 10 Drawing Sheets

FIG.8a
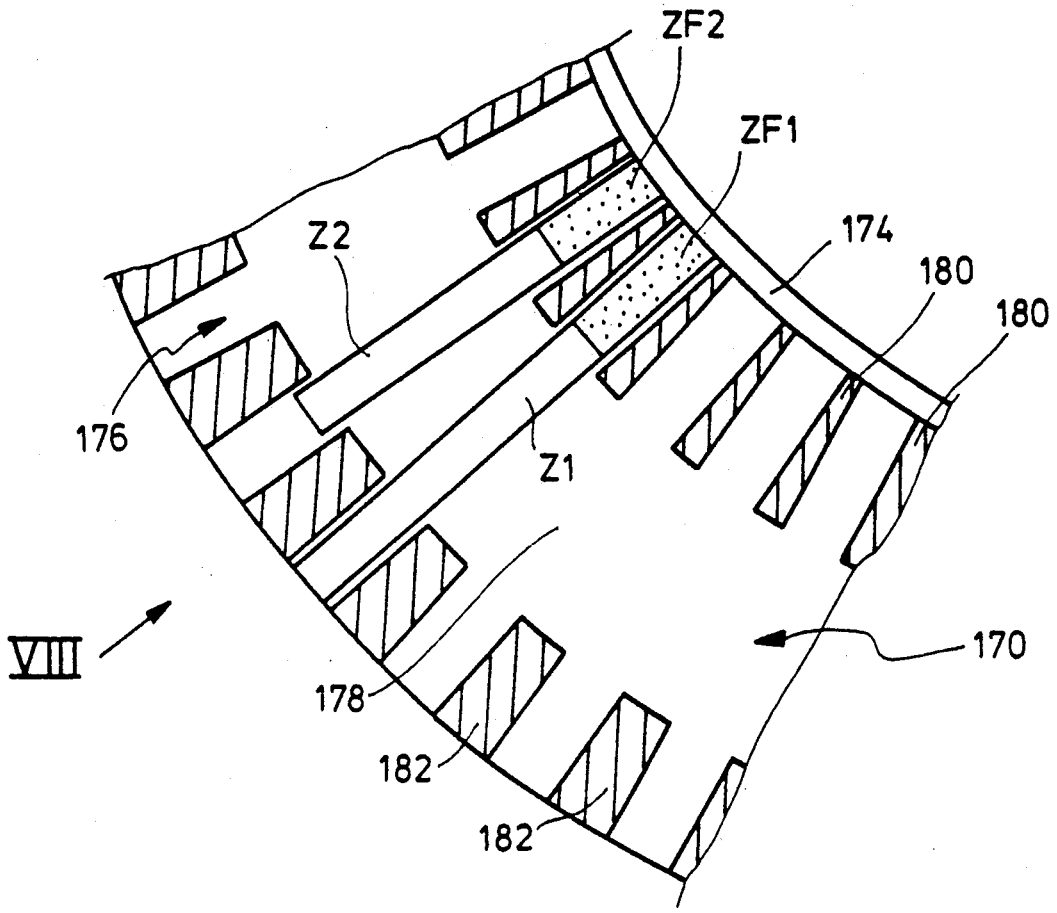
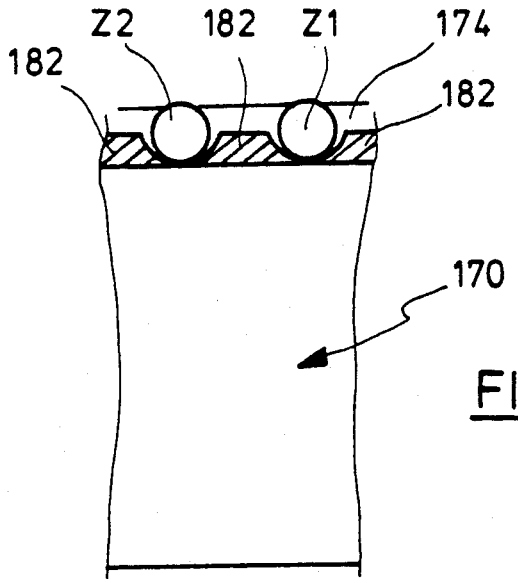
FIG.8b

METHOD AND APPARATUS FOR DETERMINING THE FILLING CAPACITY OF TOBACCO AND THE HARDNESS OF CIGARETTES

BACKGROUND OF THE INVENTION

The invention relates to a method for determining the filling capacity of tobacco, in which method, in a container closed on one side by a movable test plunger, a force is exerted on a given quantity of tobacco by the test plunger, and in which method the length of the tobacco column under the effect of the force and the time are measured.

The filling capacity corresponds to the visco-elasticity or compressibility of tobacco. It can be defined as the volume which a given mass of tobacco occupies after being subjected to a certain pressure for a certain time. The filling capacity of tobacco is greatly dependent on its temperature and moisture. As tobacco displays a marked relaxation behavior, a reproducible measurement of the filling capacity of tobacco is only possible using a process which is also precisely defined as regards time. The filling capacity depends on the type of tobacco and is an important characterizing variable for the evaluation of tobacco quality.

A method and an apparatus for the determination of the filling capacity of cut tobacco are known from the article, "Untersuchungen mit einem verbesserten Densimeter zum Pruefen der Fuell-faehigkeit von Schnittabak und der Haerte von Cigaretten", by H. W. Lorenz and F. Seehofer, Beitraege zur Tabakforschung, Volume 4, Issue 7 (1968). To measure the filling capacity, about 20 g of tobacco are poured loosely into a cylindrical container of about 60 mm diameter. After this container has been inserted in the known apparatus, a pressure plate on which a weight has been placed is lowered from above onto the tobacco by an electric motor. As soon as the pressure plate lies on the tobacco, the motor continues to run idle until it reaches an end position. The position of the pressure plate and consequently the height of the tobacco column is transmitted to a dial gauge or another display device. After a preselected time, of the order of one minute, has passed, the motor automatically lifts away the pressure plate with the superimposed weight from the compressed cut tobacco, and the final height of the tobacco column, which decreases with time, is displayed as a measure of the filling capacity.

In this method using the known apparatus, in the initial phase while the pressure plate is being lowered onto the cut tobacco the force acting on the tobacco builds up quickly but in a poorly reproducible manner. Thereafter the force is determined by the superimposed weight. The known method is consequently limited to the application of an essentially constant test force. Accurate measurement of a curve which represents the pattern of the final height of the tobacco column as a function of time is complicated because an individual measurement must be carried out for each time value. The temperature and the moisture or the water content of the tobacco, which have a considerable influence on the filling capacity, cannot be measured directly in the known apparatus. The moisture, for example, must be determined separately using a drying cabinet. The tobacco moisture can change during the lengthy filling capacity measurements or when the associated moisture determination is not carried out immediately before or after the measurements, which leads to a distortion of the results for the filling capacity.

The object of the invention is to provide a method of the type mentioned in the introduction for determining the filling capacity of tobacco which is not limited to the application of a constant test force. The filling capacity is to be measured with high accuracy taking into account the significant parameters. Moreover, the method is to be fully automatic. The method is to be usable for leaf tobacco as well as cut tobacco.

To achieve this object, the test plunger for exerting the force is driven by a motor in a pre-set manner, thereby compressing the tobacco, the force exerted on the tobacco is measured on the test plunger or on a supporting surface of the container, the length of the tobacco column is measured via the distance covered by the test plunger, the measured values for force and distance are acquired during the compression and sent via data transducers and interfaces to a computer for further processing, and further parameters governing the value of the filling capacity are determined in independent measurements and passed to a computer.

This means that the method runs reliably, quickly, easily and is user-friendly. Since the force acting on the tobacco is measured during the compression of the tobacco, a great many test possibilities open up for the evaluation of the variable "filling capacity" which is complex by nature. Driving the test plunger by a motor permits the use of larger containers to hold the tobacco, and as a result a larger quantity of tobacco can be tested and the reproducibility of the measured values obtained is improved. The use of larger containers to hold the tobacco also makes it possible to test leaf tobacco, so that the method is not restricted to cut tobacco. Filling capacity values obtained for leaf tobacco can be correlated with the filling capacity values for the cut tobacco obtained subsequently from the leaf tobacco, which produces specially reliable results, because both the leaf tobacco and the cut tobacco are tested according to the same method. Because the movement of the test plunger takes place in a pre-set manner, automatic calibration measurements for testing the unit can be integrated into the normal process procedure. All measured values are immediately sent to a computer, and thus an evaluation of the data, e.g. in the form of a curve showing the pattern of the force acting on the tobacco as a function of the length of the tobacco column, is considerably simplified. In addition, future changes in the test procedure can easily be made by modifications to the computer programs.

A further object of the invention is to determine the relaxation behavior of tobacco which is important for the evaluation of the filling capacity.

The object is achieved in that the test plunger rests in its end position for a relaxation period after the completion of its compression movement and in that the force acting on the tobacco is measured at predetermined time intervals during the relaxation period and transmitted to the computer for further processing.

In this way another informative curve is obtained which represents the force, decreasing in the course of the relaxation period, which the tobacco exerts on the test plunger, as a function of time. The conditions are well defined, because the length of the tobacco column is held constant. Altogether, therefore, curves are available with relevant data for the filling capacity, from which one or more values can be taken for the characterization of an assigned filling capacity value. Because the relaxation measurement takes place immediately following the compression movement of the test plunger, the total expenditure for the implementation of the method increases by only an insignificant amount as a result of the relaxation measurement.

Another object of the invention is to measure all the parameters governing the value of the filling capacity.

To achieve this object, during or immediately after the compression, the temperature and the moisture of the tobacco are determined by means of measurement devices fitted in the container or on the test plunger.

The fact that the measurements of the temperature and the moisture of the tobacco take place in the container and in immediate time proximity to the determination of the filling capacity data, ensures that their values also actually correspond to the temperature and moisture of the tobacco during the compression and relaxation measurements. Once these values are known, the filling capacity data of a given measurement or test procedure can be adjusted to reflect standard conditions (e.g. 22° C., 12% tobacco moisture). This considerably simplifies the comparison of filling capacity data obtained in different measurements.

The invention also relates to a method for determining the hardness of cigarettes, in which method a force is exerted on a given number of cigarettes, lying on an essentially flat sample holder, by a test plunger which can be moved vertically to the surface of the sample holder and which has a pressure surface running parallel to the surface of the sample holder, and in which method the thickness of the cigarettes under the effect of the force and also the time are measured.

The hardness of a cigarette is a significant variable for the evaluation of its quality. The hardness is closely correlated with the filling capacity of the cut tobacco; a cut tobacco of high filling capacity produces a hard cigarette for a given cigarette size and a given tobacco weight. A method for determining the hardness of cigarettes can proceed in a completely analogous manner to a method for determining the filling capacity of tobacco. It is only necessary to ensure, by a suitable construction of the surfaces coming into contact with the tobacco product that the forces acting on the tobacco product are transmitted in a optimal manner.

Thus the already mentioned apparatus from the article "Untersuchungen mit einem verbesserten Densimeter zum Pruefen der Fuellfaehigkeit von Schnittabak und der Haerte von Cigaretten", by H. W. Lorenz and F. Seehofer, Beitraege zur Tabakforschung, Volume 4, Issue 7 (1968) also makes possible a method for determining the hardness of cigarettes. To carry out a hardness measurement, 10 cigarettes are placed on a base-plate which replaces the cylindrical container for cut tobacco. At the beginning of the hardness measurement the motor lowers onto the cigarettes from above a pressure plate matched in size to the base-plate, with a superimposed weight. The further procedure takes place exactly as described in connection with the determination of the filling capacity of cut tobacco. The disadvantages of the method implemented with the known apparatus are also for the determination of hardness limitation to an essentially constant test force, complicated and lengthy procedure, no simultaneous measurement of temperature and moisture of the cigarettes.

An apparatus for determining the hardness of cigarettes is also known in which, at the beginning of the hardness determination, a weight of ca. 5 g per cigarette is imposed on a given number of cigarettes by a motor via a pressure plate. At this moment the thickness of the cigarettes is measured, i.e. the distance between the base-plate beneath the cigarettes and the pressure plate. As the procedure continues the force on the cigarettes is increased, but is not measured until there is a defined value of ca. 250 g per cigarette. At this point, the thickness of the cigarettes is measured again. The method carried out with this known apparatus to determine the hardness of cigarettes thus supplies a link between the force and the thickness of the cigarettes, but there are only two measuring points for this. A fundamental problem in the use of weights is that the force acting on the tobacco product can be reduced by an unknown amount due to frictional forces.

It is an object of the invention to improve the method of the type mentioned before for determining the hardness of cigarettes. Like in the method for determining the filling capacity of tobacco, the method is not to be limited to a constant force acting on the cigarettes, or to only two different force values, it is to be fully automatic and is to supply measured data of a high degree of accuracy taking into account additional parameters governing the hardness.

This object is achieved in that the test plunger for exerting the force is driven in a pre-set manner by means of a motor, thereby compressing the cigarettes, the force exerted on the cigarettes is measured on the test plunger or on the sample holder, the thickness of the cigarettes is measured by means of the distance covered by the test plunger, the measured values for the force and distance are acquired during the compression and transmitted via data transducers and interfaces to a computer for further processing, and further parameters governing the value of the hardness are determined in independent measurements and passed to a computer.

In this way the advantages already mentioned in connection with the filling capacity determination of tobacco are achieved. Analogous to a large container for holding the cut tobacco or leaf tobacco, this time a large sample holder can be used on which many cigarettes can be placed. A good reproducibility of the measured force is then achieved, because during the course of the process an averaging takes place via a large number of cigarettes.

Another object of the invention, to obtain relevant relaxation data for the hardness of cigarettes, is achieved in that, after the completion of the compression movement of the test plunger, the test plunger rests in its end position for a relaxation period and that during the relaxation period the force acting on the cigarettes is measured at predetermined time intervals and transmitted to the computer for further processing. The thus obtained advantages correspond to those listed in connection with the relaxation measurements on tobacco.

The object of the invention to measure all parameters governing the value of the hardness of cigarettes is achieved in that the temperature and moisture of the cigarettes are determined during or immediately after compression by means of measurement devices fitted on the test plunger and/or on the sample holder. In this way reliable temperature and moisture values for the cigarettes are available which can be used for adjusting the hardness data obtained to reflect standard conditions (e.g. 22° C., 12% moisture). This simplifies a comparison of hardness data which have been obtained in different measurement procedures.

The invention also relates to an apparatus for determining the filling capacity of tobacco, comprising a container, open on one side, for holding the tobacco, a test plunger, which can be moved in one direction into the container and which closes off the latter, for exerting a force on the tobacco, a distance-measurement device for determining the length of the tobacco column between the test plunger and a wall of the container lying opposite thereto, and a time-measurement device.

An apparatus of this generic type is known from the article, "Untersuchungen mit einem verbesserten Densimeter zum Pruefen der Fuellfaehigkeit von Schnittabak und der Haerte von Cigaretten", by H. W. Lorenz and F. Seehofer, Beitraege zur Tabakforschung, Volume 4, Issue 7 (1968) as discussed in connection with the method for determining the filling capacity of tobacco.

It is an object of the invention to provide an apparatus which implements the method for determining the filling capacity of tobacco as explained before.

To achieve this object, the apparatus comprises a computer-controlled drive device containing a motor for the test plunger for the exertion of the force on the tobacco, force-measurement devices fitted on the test plunger or on the supporting surface of the container, and data transducers and interfaces for the automatic acquisition of the measured values for the force and the length of the tobacco column and their transmission to a computer.

This apparatus has measurement devices fitted in the container or on the test plunger for the determination of the temperature of the tobacco and also data transducers and interfaces for the automatic acquisition of the values representing the temperature and their transmission to the computer. In an advantageous manner two platinum precision resistors for determining the temperature of the tobacco are fitted on the surface of the test plunger which is in contact with the tobacco and on the inner wall of the container which is opposite thereto.

The apparatus moreover has measurement devices fitted in the container or on the test plunger for determining the moisture of the tobacco and also data transducers and interfaces for the automatic acquisition of the values representing the moisture and for their transmission to the computer. In an advantageous manner, on the surface of the test plunger which is in contact with the tobacco and on the inner wall of the container which is opposite thereto in each case an arrangement composed of several mutually insulated electrodes is fitted which can be connected to a power source so as to determine by means of the measured current flowing through the tobacco and/or the measured voltage, the electrical conductivity as a measure of the moisture of the tobacco.

The drive device for the test plunger preferably contains a precision spindle rotated by a stepping motor, and the number of steps covered by the stepping motor is a measure of the length of the tobacco column.

The invention relates in addition to an apparatus for determining the hardness of cigarettes, comprising an essentially flat sample holder for holding the cigarettes, a test plunger movable vertical to the surface of the sample holder for exerting a force on the cigarettes, which has a pressure surface running parallel to the surface of the sample holder, a distance-measurement device for determining the thickness of the cigarettes situated between the pressure surface of the test plunger and the surface of the sample holder, and a time-measurement device.

An apparatus of this generic type is also known from the article, "Untersuchungen mit einem verbesserten Densimeter zum Pruefen der Fuellfaehigkeit von Schnittabak und der Haerte von Cigaretten", by H. W. Lorenz and F. Seehofer, Beitraege zur Tabakforschung, Volume 4, Issue 7 (1968) and has already been discussed in connection with the method for determining the hardness of cigarettes.

It is an object of the invention to provide an apparatus for determining the hardness of cigarettes which implements the method discussed above for determining the hardness of cigarettes.

The object is achieved in that the apparatus for determining the hardness of cigarettes comprises a computer-controlled drive device containing a motor, for the test plunger used to exert the force to the cigarettes, force-measurement devices fitted on the test plunger or on the sample holder, and data transducers and interfaces for the automatic acquisition of the measured values for the force and the thickness of the cigarettes and for their transmission to a computer.

Preferably, the apparatus for determining the hardness of cigarettes comprises measurement devices fitted on the sample holder, or on the test plunger, for determining the temperature and the moisture of the cigarettes, and also data transducers and interfaces for the automatic acquisition of the values representing the respective measured variable and for their transmission to the computer.

The drive device for the test plunger of this apparatus can have a precision spindle rotated by a stepping motor, in which the number of steps covered by the stepping motor can be used as a measure of the thickness of the cigarettes.

The test plunger is advantageously constructed in the shape of a ring. The sample holder for holding the cigarettes has a plurality of radially arranged recesses which are each about the length of a cigarette, formed plane in the central area opposite the test plunger and delimited, in the two end regions, from the respective neighboring recesses by ridges. With a thus constructed sample holder and the associated pressure surface, a large number of cigarettes can be subjected to the hardness determination simultaneously. The geometry of the pressure surface and the sample holder ensures that the forces can be transmitted evenly from the pressure surface of the test plunger to the cigarettes.

In order also to determine the firmness or hardness of the cigarette filters, the annular test plunger can preferably be removed from the apparatus and replaced by a second ring, which after fitting is situated above the region of the filters of the cigarettes lying in the sample holder. The test procedure for determining the hardness of the filters is identical to that for determining the hardness of the cigarettes.

It is also an object of the invention to provide an apparatus with which both the filling capacity of tobacco and also the hardness of cigarettes can be determined according to the methods explained above, so as to reduce the total costs of these machines.

This object is achieved in that, on a functioning apparatus for the determination of the filling capacity of tobacco, the test plunger for the filling capacity determination with the measurement devices situated thereon can be replaced by the test plunger for the hardness determination with the measurement devices situated thereon, and that the container for the filling capacity determination with the measurement devices situated therein can be replaced by the sample holder for the hardness determination with the measurement devices situated thereon.

These and further objects and advantages of the present invention will become more apparent upon reference to the following specification, appended claims and drawings.

BRIEF DESCRIPTION OF THE DRAWING FIGURES

Figure 1:
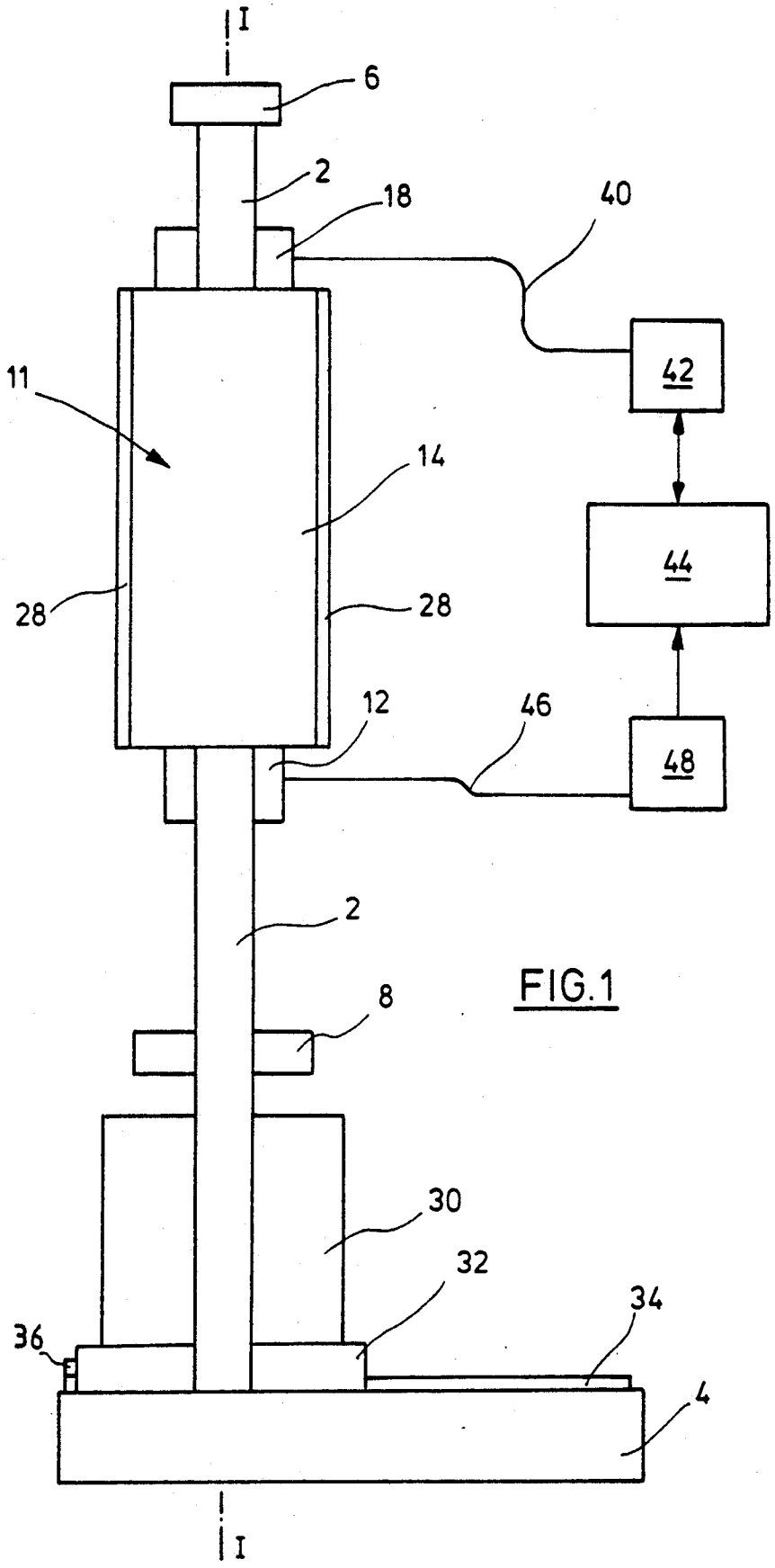
FIG. 1 is a side elevational view of an apparatus for determining the filling capacity of tobacco.
Figure 2:
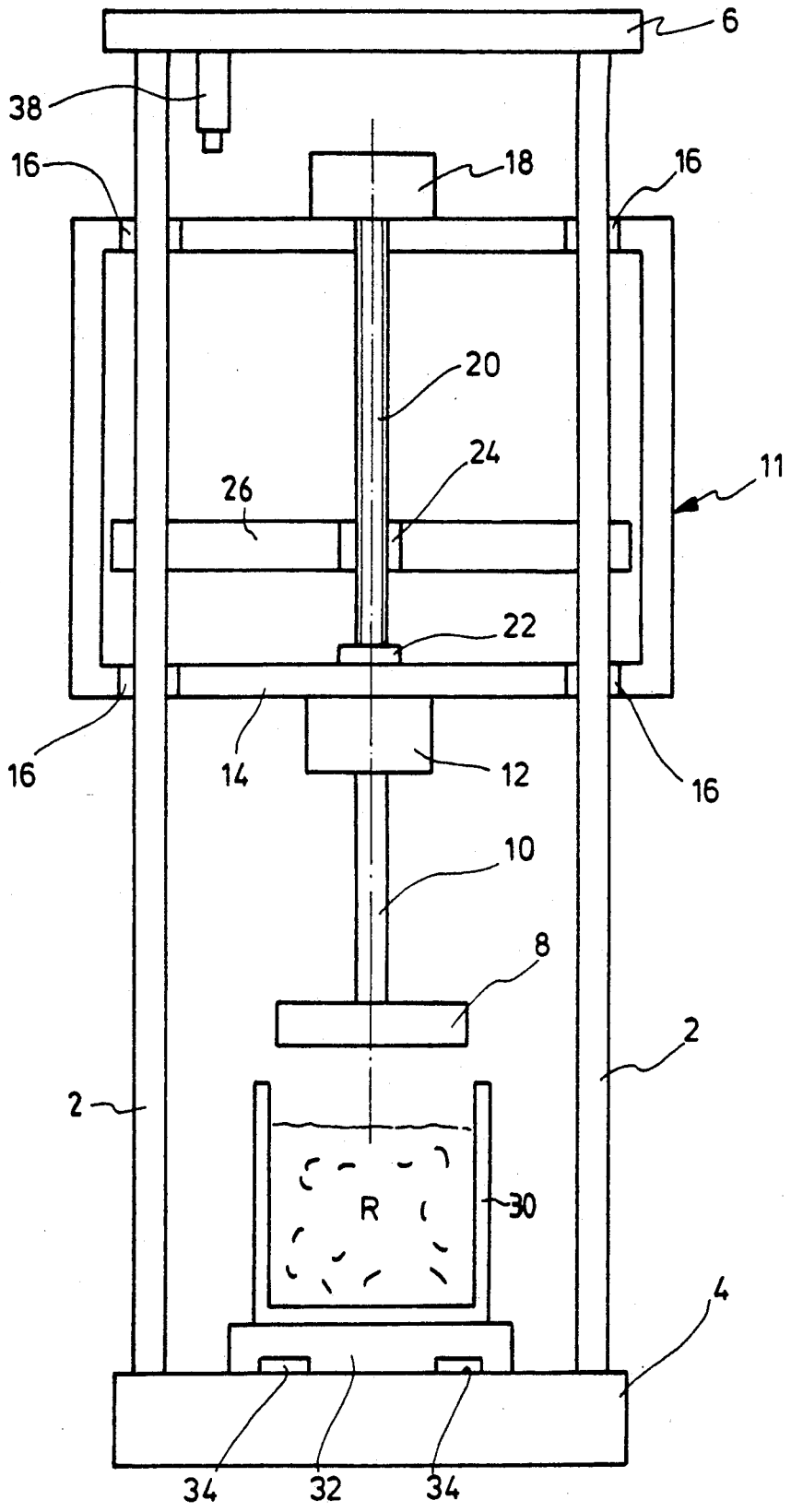
FIG. 2 is a front elevational view of the apparatus from FIG. 1 in the form of a section along the line I—I from FIG. 1.
Figure 3B:
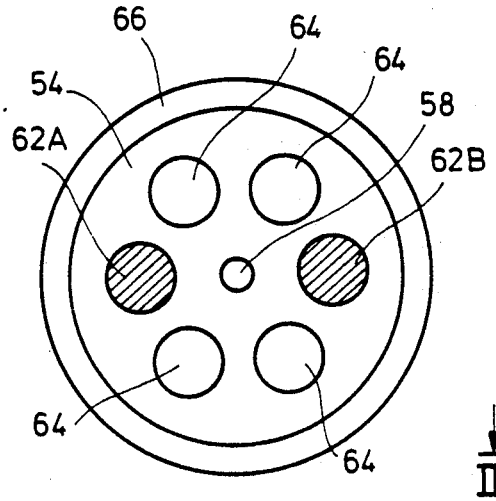
FIG. 3(*a*) is a longitudinal cross-section and FIG. 3(*b*) is a cross-section along the line III—III of FIG. 3(*a*) of an arrangement of the temperature sensors and electrodes for the determination of the moisture of the tobacco in the apparatus from FIGS. 1 and 2.
Figure 3A:
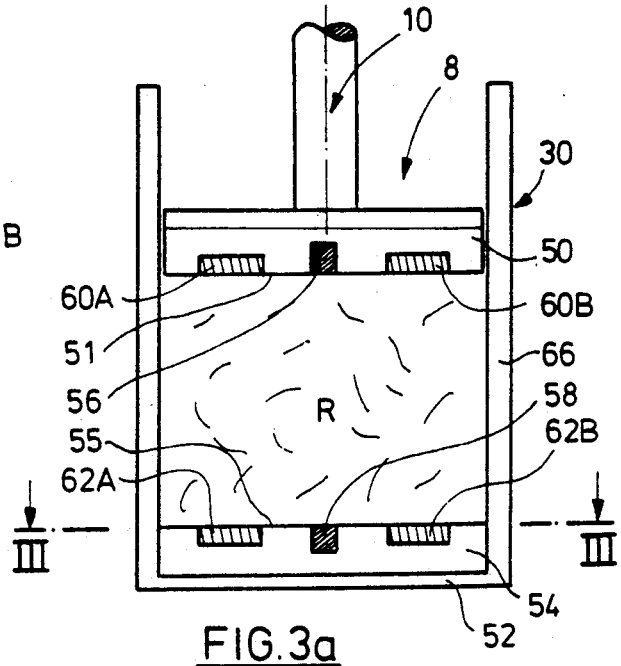
Figure 4A:
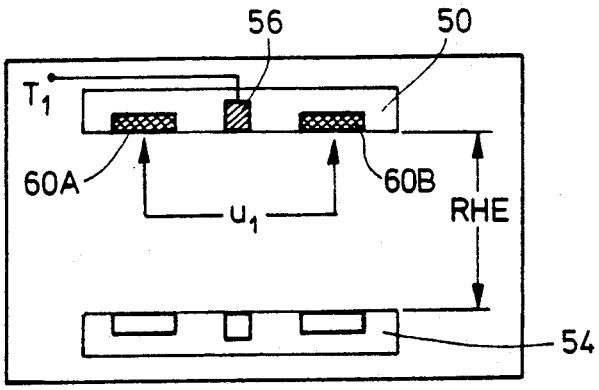
Figure 4B:
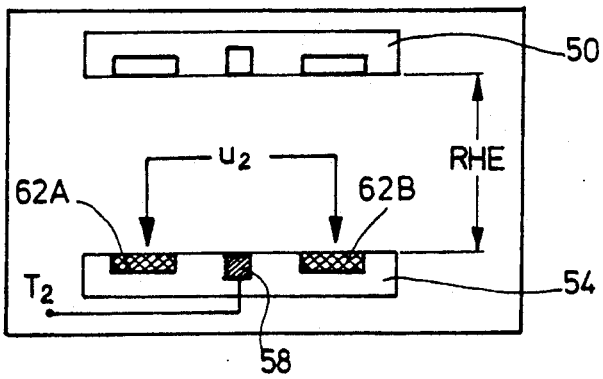
Figure 5:
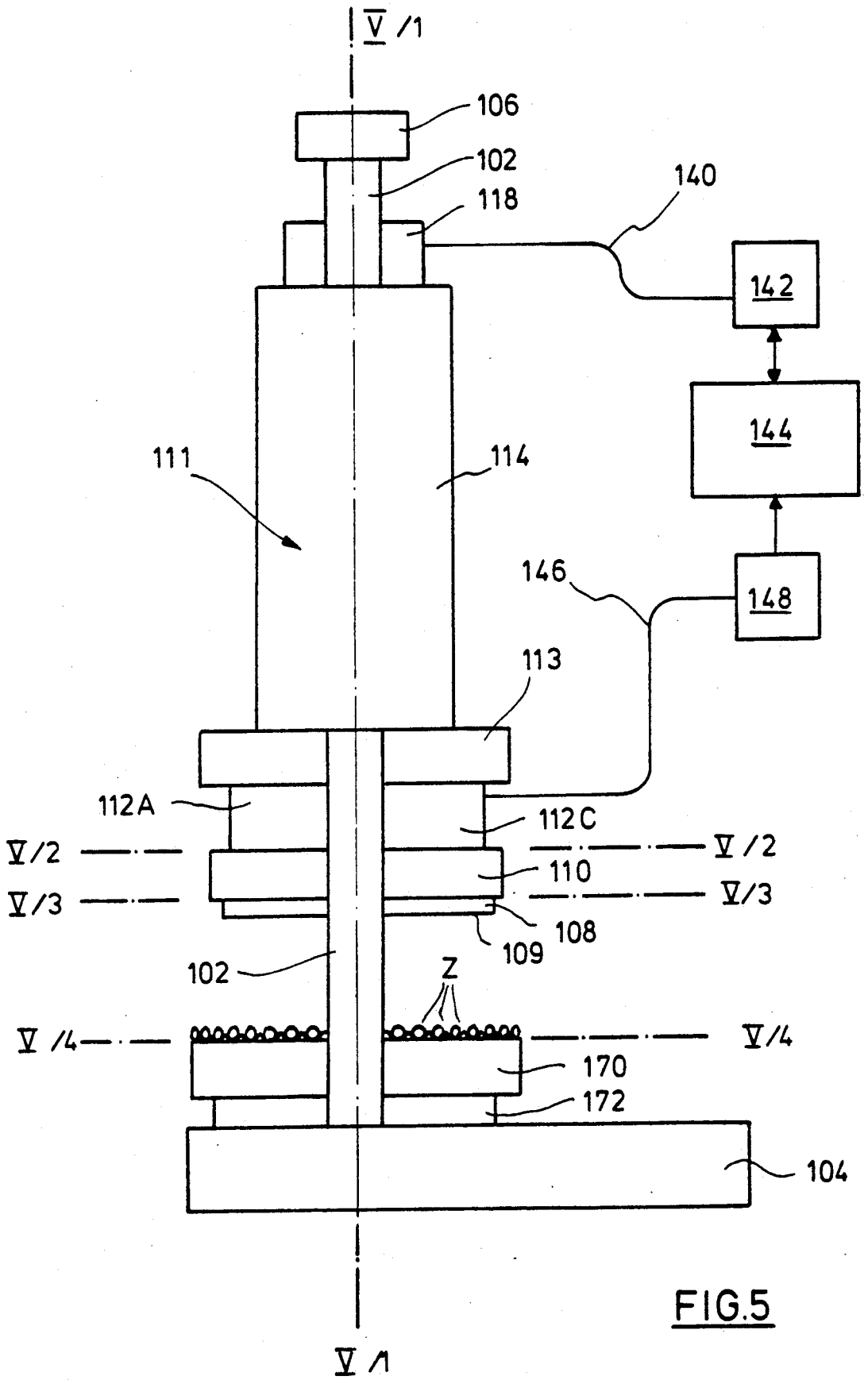
Figure 6:
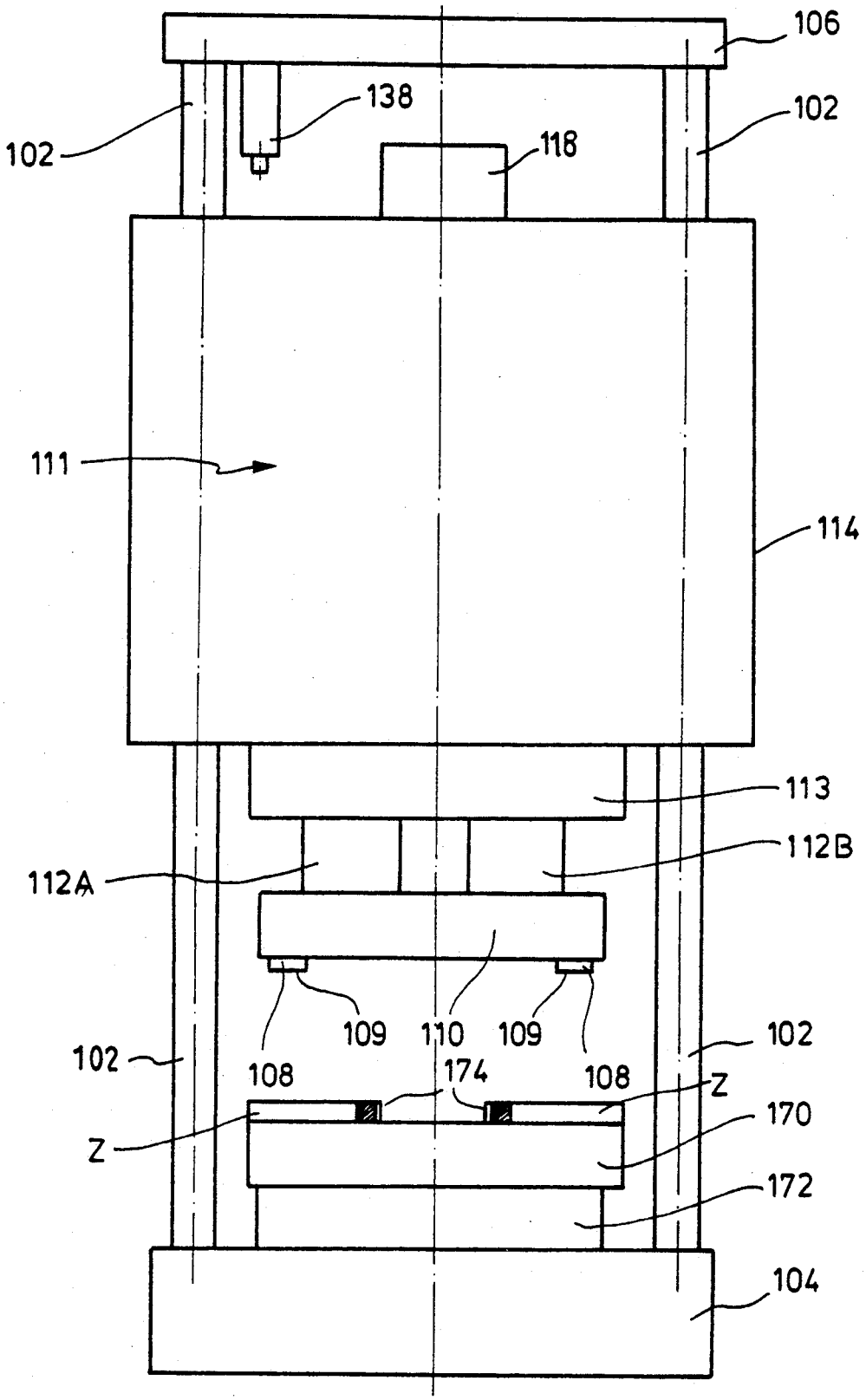
Figure 7A:
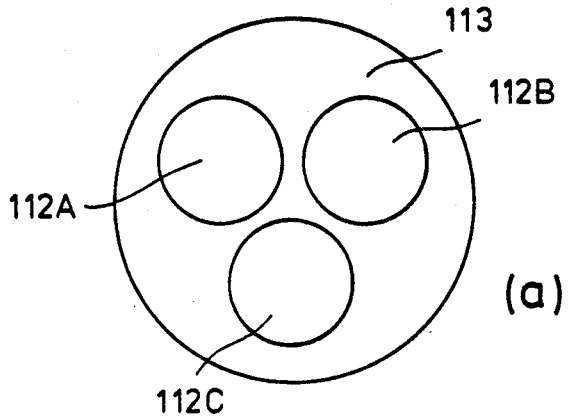
Figure 7B:
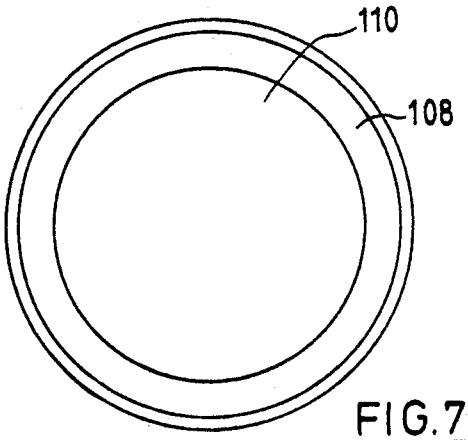
Figure 7C:
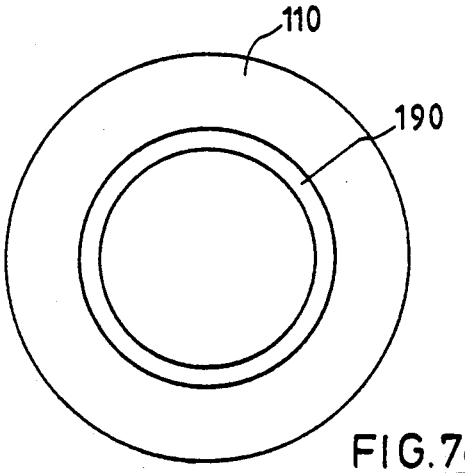
Figure 7D:
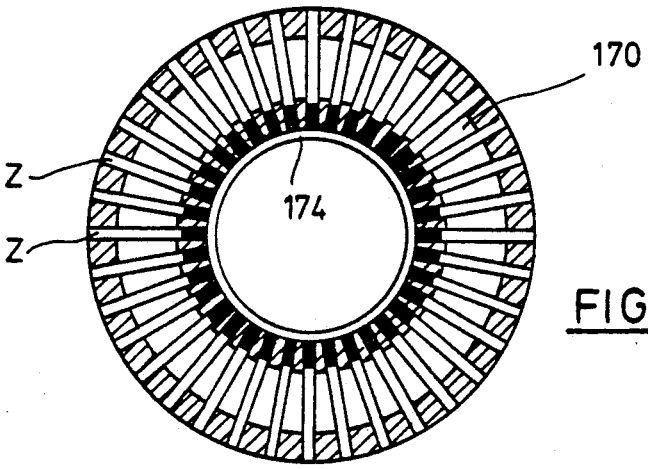
Figure 9A:
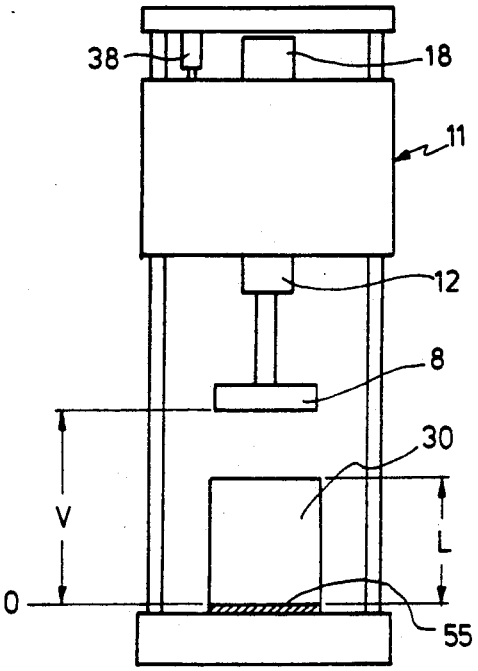
Figure 9B:
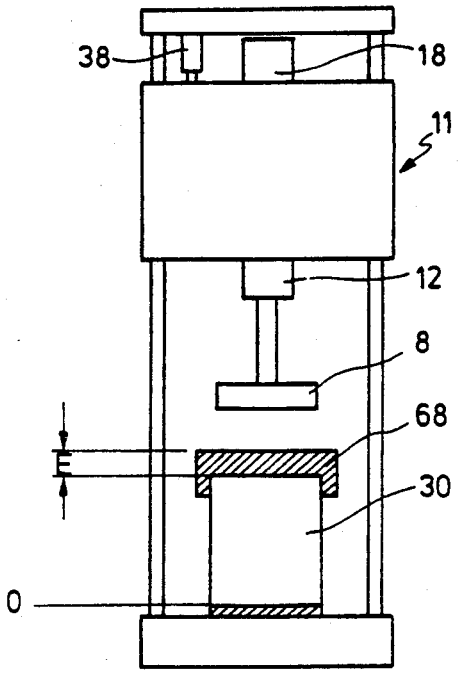
Figure 9D:
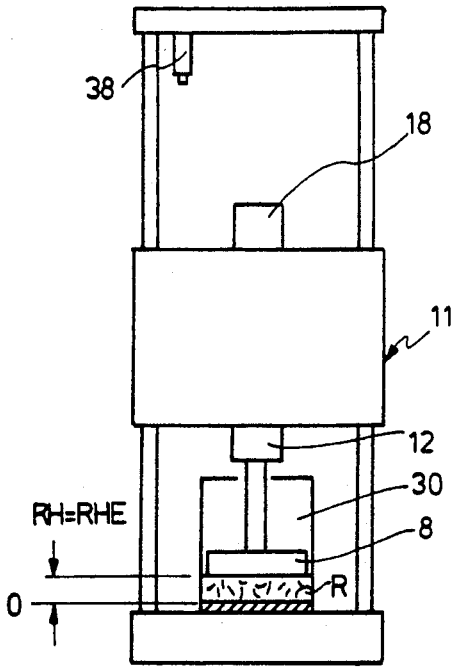
Figure 9C:
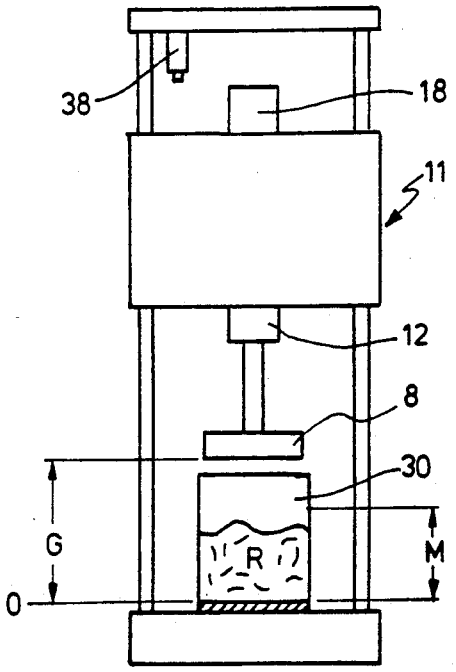
Figure 10:
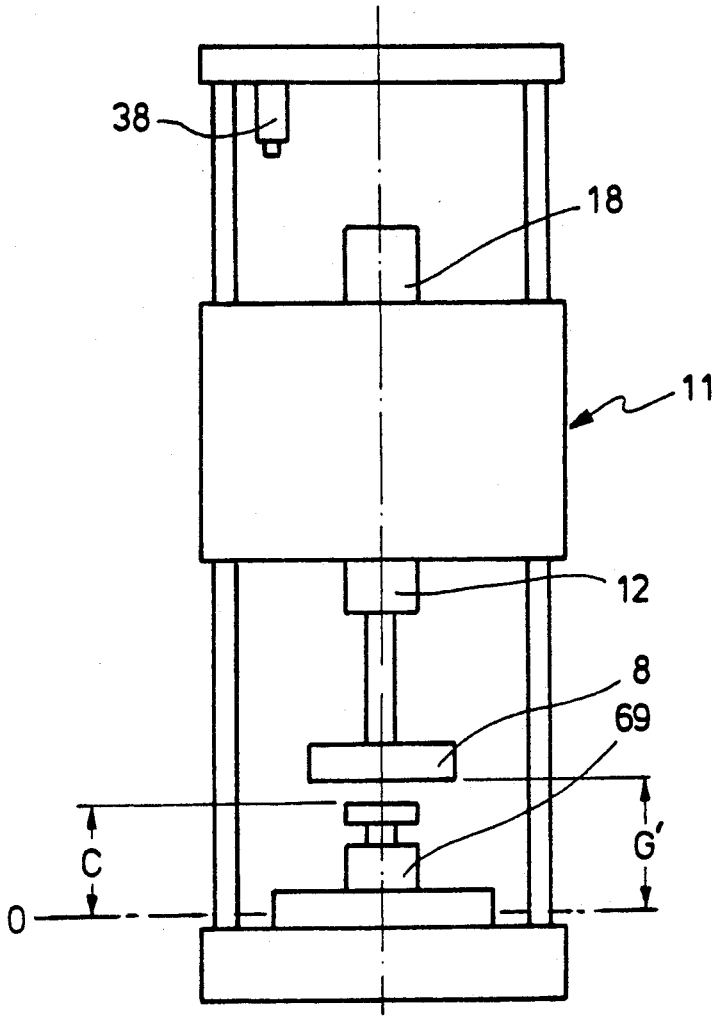
Figure 11:
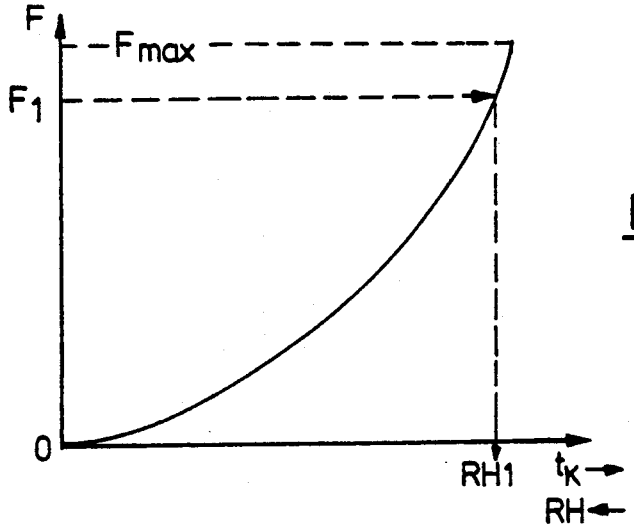
Figure 12:
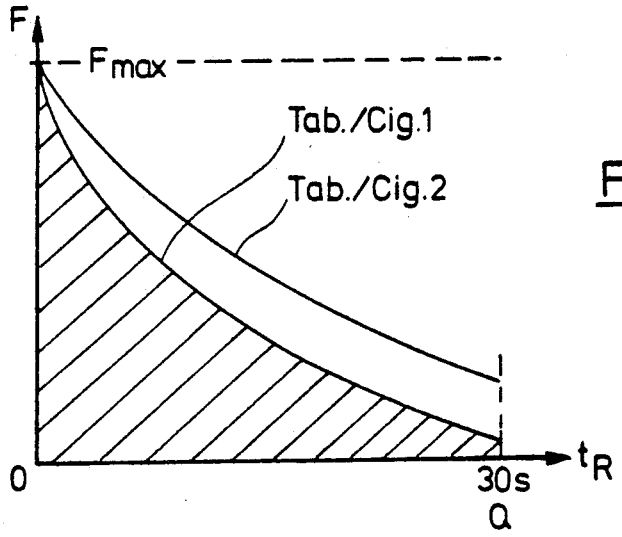
Figure 13:
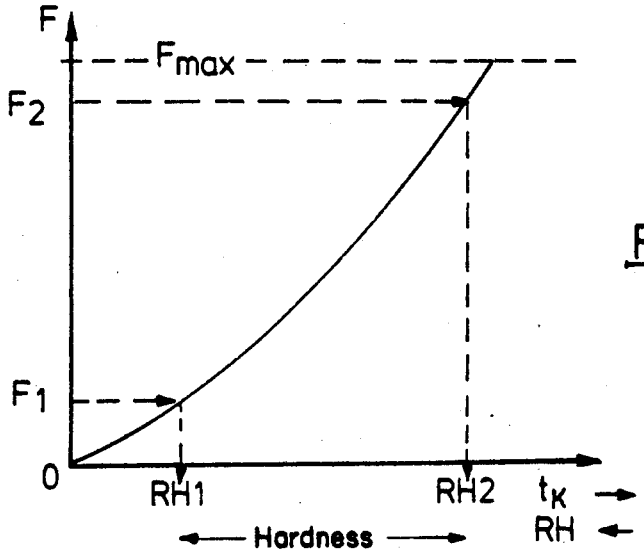

FIGS. 4(*a*) and (*b*) illustrate two stages for the determination of the temperature and the moisture of the tobacco by means of the arrangement from FIG. 3;

FIG. 5 is a side elevational view of an apparatus for determining the hardness of cigarettes;

FIG. 6 is a front cross-sectional view of the apparatus of FIG. 5 taken along the line V/1—V/1;

FIGS. 7(*a*), (*b*), (*c*) and (*d*) are various cross-sections of the apparatus of FIGS. 5 and 6, FIG. 7 (*a*) being sections along the line V/2—V/2 from FIG. 5, FIG. 7(*b*) and FIG. 7(*c*) being a section along the line V/3—V/3 from FIG. 5, with a filter plunger used in FIG. 7(*c*) in place of a test plunger, and FIG. 7(*d*) being a section along the line V/4—V/4 of FIG. 5;

FIGS. 8(*a*) and (*b*) illustrate a sample holder of the apparatus from FIGS. 5 to 7, FIG. 8(*a*) being a sectional enlargement from FIG. 7(*d*) and VIII of FIG. 8(*a*);

FIGS. 9(*a*), (*b*), (*c*) and (*d*) illustrate various steps in the implementation of the method for determining the filling capacity of tobacco by means of the apparatus shown in FIGS. 1 and 2, FIG. 9(*a*) showing the starting position of the apparatus, FIG. 9(*b*) showing the process for adjusting the distance-measurement, FIG. 9(*c*) showing the procedure for compression of the tobacco and FIG. 9(*d*) showing the procedure for a relaxation measurement;

FIG. 10 illustrates the calibration procedure for a force-measurement device using the apparatus shown in FIGS. 1 and 2;

FIG. 11 illustrates a compression curve for cut tobacco which shows the force F exerted on the cut tobacco as a function of the residual height RH of the tobacco column;

FIG. 12 illustrates two relaxation curves for cut tobacco or cigarettes which show the exerted force F as a function of time $t_r$ while the residual height is kept constant; and FIG. 13 illustrates a compression curve for cigarettes which shows the force F exerted on the cigarettes as a function of the residual height RH of the cigarettes.

DETAILED DESCRIPTION OF THE DRAWING FIGURES

Reference will now be made in detail to a present preferred embodiment of the invention, an example of which is illustrated in the accompanying drawings.

First of all the construction of the apparatus shown in FIGS. 1 and 2 for determining the filling capacity of tobacco will be described. Two parallel guide rods 2 are fixed on a base 4 and stabilized at their upper ends by a cross-bar 6. A test plunger 8 which is circular in cross-section is mounted by means of a connecting rod 10 on a slidable cross-piece 11. The slidable cross-piece 11 can be moved along the guide rods 2. The forces occurring on the test plunger 8 can be determined by means of a force-measurement device 12, which is installed between the connecting rod 10 and the underside of the slidable cross-piece. The slidable cross-piece 11 contains a frame 14 which is movable along the guide rods 2 by means of slide bearings 16. On the upper end of the frame 14 there is a stepping motor 18. The stepping motor 18 drives a precision spindle 20 which is supported at its lower end in a bearing 22 fixed to the frame 14. A nut 24, which is engaged with the precision spindle 20, is fixed rigidly to a cross-piece 26, which is in turn fixedly connected with the guide rods 2. This drive of the slidable cross-piece 11 via the spindle 20 allows the slidable crosspiece 11 to be lifted or lowered. No rotatable parts are in evidence here externally; in particular the force-measurement device 12 is connected rigidly with the frame 14. The slidable cross-piece 11 is covered by two casing sheets 28, which run in planes parallel to the plane of FIG. 2, as can be seen from FIG. 1.

The tobacco R is situated in a cylindrical container 30, the inner diameter of which is slightly larger than the external diameter of the test plunger 8. The container 30 sits on a carriage 32, which slides on two rails 34 and can be moved laterally, as shown in FIG. 1. A stop piece 36 on each rail 34 defines the exact position of the carriage 32 and the container 30 in relation to the test plunger 8.

On the cross-bar 6 a limit-switch 38 is mounted which is activated when the slidable cross-piece 11 moves upwards, as soon as the latter has reached its highest permitted position. The stepping motor 18 is switched off safely thereby, and also regardless of the other control signals which it receives.

A flexible connection cable 40 connects the stepping motor 18 to a stepping motor control system 42, see FIG. 1. The stepping motor control system 42 is connected to a computer 44. Since the pitch of the precision spindle 20 is known, the position of the slidable cross-piece 11 and thus that of the test plunger 8 is obtained with a high degree of accuracy by the number of steps covered by the stepping motor 18. In order that this type of distance-measurement functions, however, after the device has been turned on the absolute position of the test plunger 8 must first be determined. For this purpose the test plunger 8 is moved to a set-up adjustment gauge. Starting from this known distance between the lower edge of the test plunger 8 and a predetermined zero point position, the stepping motor control system 42 and the computer 44 keep track of all the forward and backward steps of the stepping motor 18, so that at any subsequent moment the absolute distance between the lower edge of the test plunger 8 and the predetermined zero point position can be calculated. The adjustment procedure using the adjustment gauge is described in more detail below in connection with the description of the method for the determination of the filling capacity of tobacco. The stepping motor control system 42 and the computer 44 therefore perform not only the control of the slidable crosspiece 11, but also the measurement of the distance covered by the test plunger 8. The necessary data converters and interfaces are contained here in the stepping motor 18, the stepping motor control system 42 and the computer 44. Alternatively a distancemeasurement could also be carried out by means of an external length-measurement device, which reports the absolute position of the test plunger 8 at any moment to the computer 44 via a data transducer and an interface.

In the embodiment the force-measurement device 12 consists of a commercially available force-measurement hub. The values measured by the force-measurement device 12 are transmitted to the computer 44 via an interface 48. These values differ from the force exerted on the tobacco by the test plunger 8 by a constant weight force, because the force-measurement device 12 is not mounted directly on the boundary between the test plunger 8 and the tobacco R. The method for determining the filling capacity of tobacco allows the measured force values to be adjusted to take account of these constants and in addition makes it possible to calibrate the force-measurement device 12 used, see below. Alternatively one or more force-measurement devices could also be installed underneath the container 30.

FIG. 3 shows an arrangement of temperature sensors and electrodes for determining the temperature and moisture of the tobacco R. In its lower region, the test plunger 8 consists of an insulator 50, the lower edge of which defines the lower edge 51 of the test plunger. On the bottom 52 of the container 30 there is also an insulator 54 fitted, the upper edge of which defines the upper edge 55 of the bottom. A first temperature sensor 56 is embedded in the insulator 50 of the test plunger 8, and a second temperature sensor 58 is embedded in the insulator 54 on the bottom of the container 30. The two temperature sensors are preferably Pt 100 resistors. These are precision resistors made from platinum, through which in a known manner a constant current can be passed; the voltage drop measured along the resistors is a measure of the temperature. The temperature sensors 56 and 58 are connected to a computer via data transducers and interfaces (not shown). This can be the computer 44. In the embodiment, however, two inter-communicating computers are used, one main computer and the computer 44 as an auxiliary computer. In this case the temperature measurements are sent to the main computer.

The moisture of the tobacco R is determined by a resistance measurement. For this purpose two first electrodes 60A and 60B are situated on the insulator 50 of the test plunger 8 and two second electrodes 62A and 62B are situated on the insulator 54 on the bottom of the container 30. These electrodes are connected with a known measurement device for determining the moisture of tobacco (not shown), and the results for the moisture of the tobacco are transmitted via an interface (not shown) to the computer, here the main computer. Moisture is measured in principle by the application of an a.c. voltage with constant amplitude between two electrodes. The current flowing through the tobacco is converted via a resistor into a voltage which is consequently a measure of the electrical resistance of the tobacco and therefore its moisture. This voltage is passed to the main computer via an interface. The measurement device for determining the moisture of the tobacco must occasionally be calibrated using tobacco of known moisture. Between the two electrodes 62A and 62B on the bottom of the container 30, metal disks 64 are attached to the insulator 54. Corresponding metal disks are also situated between the first electrodes 60A and 60B. When a voltage is applied to the first electrodes 60A, 60B, or the second electrodes 62A, 62B these metal disks enlarge the area of tobacco covered by the measurement and consequently increase the reliability of the moisture measurements. The inside of the side wall 66 of the container 30 is provided with an electrically insulating coating.

FIG. 4 shows how the electrodes are connected in the embodiment to measure the moisture of the tobacco R. After the tobacco column in the container 30 has been compressed to its final residual height RHE in the course of the method for determining the filling capacity of tobacco (see below), first a voltage is applied between the two electrodes 60A and 60B. The measurement value $U_1$ corresponds to a first value for the moisture of the tobacco. At the same time, the temperature $T_1$ of the tobacco is measured via the first temperature sensor 56, and the measured values are passed to the main computer. This is shown in FIG. 4(*a*). Following this, the voltage is applied between the two electrodes 62A and 62B, FIG. 4(*b*). Its measured value $U_2$ is transmitted to the main computer together with the temperature $T_2$ determined by the second temperature sensor 58. The main computer can calculate representative average values from the temperature values $T_1$ and $T_2$ and the voltage values $U_1$ and $U_2$.

FIGS. 5 and 6 show an apparatus for determining the hardness of cigarettes. This apparatus is of a similar construction to the apparatus for determining the filling capacity of tobacco, and identical or corresponding components are given reference numerals increased by 100.

Two guide rods 102 are fixed on a base 104 and at their upper ends are connected by a cross-bar 106. An annular test plunger 108 with a pressure surface 109 is mounted on a test plunger carrier 110. The test plunger carrier 110 is connected via three force-measurement devices 112A, 112B and 112C to an intermediate piece 113, which is mounted on the under-side of the frame 114 of a slidable cross-piece 111. The slidable cross-piece 111 is driven by a stepping motor 118. The drive elements of the slidable cross-piece 111 such as, for example, a precision spindle, which is supported in a cross-piece, are the same as in the apparatus for determining the filling capacity of tobacco. For this reason the components situated inside the slidable cross-piece 111 are not shown again in FIG. 6.

The stepping motor 118 is connected by means of a flexible connection cable 140 to a stepping motor control system 142 which in turn is connected to a computer 144, see FIG. 5. The control of the upward and downward movement of the slidable cross-piece 111 and the measurement of the distance covered by the test plunger 108 takes place exactly as in the apparatus for determining the filling capacity of tobacco. A limit switch 138 is fitted on the cross-bar 106.

In order to ensure a reliable measurement of the force transmitted by the test plunger 108 to the cigarettes Z, in the embodiment, three force-measurement devices 112A, 112B and 112C are provided, see FIG. 7(*a*), which connect the test plunger carrier 110 having a large surface area to the intermediate piece 113, see FIG. 7(*b*). The force-measurement devices 112A, 112B and 112C can again be constructed as commercially available force-measurement hubs. They are connected to a computer 144 by means of a flexible connection cable 146 and an interface 148. Alternatively, one or more force-measurement devices could also be fitted on the sample holder 170 described in the next paragraph.

The cigarettes Z whose hardness is to be determined, lie on a sample holder 170 which is fixed on the base 104 by means of a holding device 172. The sample holder 170 is shown particularly in FIG. 7(*d*) and in FIG. 8. The surface of the sample holder 170 is essentially flat and runs parallel to the pressure surface 109 of the test plunger 108. A plurality of cigarettes Z lie in a circular arrangement on the sample holder 170. In the radial direction the position of each cigarette Z is determined by a cylindrical stop ring 174, the height of which is about the same as the thickness of one cigarette Z, see FIG. 6 and FIG. 8(*b*). For each cigarette Z a recess 176 is provided, the length of which is the same as the distance between the stop ring 174 and the outer edge of the sample holder 170. This is sufficient to take a long cigarette Z1, see FIG. 8(*a*). In a middle region 178, the recesses 176 are formed plane or flat. The middle regions 178 of the recesses 176 are situated opposite the pressure surface 109 of the annular test plunger 108. To prevent the cigarettes from rolling away in the circumferential direction, each recess 176 is delimited from the respective neighboring recesses by inner ridges 180 and outer ridges 182. These ridges 180 and 182 are shown shaded in FIG. 8. They rise up above the plane of the middle regions 178. As can be seen from FIG. 8(*b*), due to the shape of the inner ridges 180 and the outer ridges 182, at both ends the cigarettes Z1 and Z2 lie in recess regions which preferably have the form of a section from a cylindrical barrel. The depth of both recess regions is preferably the same as the radius of a cigarette Z1, Z2 and the radius of an associated cylinder is slightly larger than the radius of a cigarette Z1, Z2. In the radial direction (relative to the sample holder 170) the inner ridges 180 extend for a length which is slightly greater than the length of a cigarette filter ZF1, ZF2. The outer ridges 182 are sufficiently long to hold both long cigarettes Z1 and short cigarettes Z2. In FIG. 8(*a*) only two cigarettes Z2 of different lengths are shown. Generally, the sample holder 170 is, however, filled completely with cigarettes Z of the same length and type.

The distance between the pressure surface 109 of the test plunger 108 and the middle regions 178 on the sample holder 170 is the same for all cigarettes Z. Because, due to manufacturing tolerances, not all cigarettes Z have the same diameter, they are compressed to different degrees during the compression movement of the test plunger. The measured values obtained for the force exerted on the cigarettes are however reliable average values because an average is taken via a large number of cigarettes. A flat middle region 178 has the advantage over a curved region that the conditions are also comparable for cigarettes of different diameters, because a suitable radius of curvature for the middle region 178 which could be optimally matched to only one cigarette diameter is not what is required.

In order also to enable a determination of the hardness of the filters ZF1, ZF2 of the cigarettes Z1, Z2, the annular test plunger 108 can be unscrewed from the test plunger carrier 110 and replaced by a second ring or filter plunger 190. As can be seen from FIG. 7(*c*), the filter plunger 190 has a smaller radius than the test plunger 108 and lies opposite the filters ZF1, ZF2 of the cigarettes Z1, Z2 on the sample holder 170. A method for determining the hardness of the cigarette filters takes place in exactly the same way as the method for determining the hardness of cigarettes.

The temperature of the cigarettes Z is determined by means of one or more temperature sensors, which are fitted on the sample holder 170, on the test plunger 108 or on the test plunger carrier 110. For this purpose, for example, Pt 100 platinum precision resistors can be used which are connected by means of a data transducer and an interface to a main computer, in a similar way to that described in connection with the apparatus for determining the filling capacity of tobacco. The moisture of the cigarettes, or more precisely, that of the tobacco in the cigarettes, can also be measured in a comparable manner and transmitted to the computer. For example, the test plunger 108 can be connected as one electrode and the sample holder 170 as the other electrode of a voltage device which determines the electrical resistance of the cigarettes Z lying on the sample holder 170 by means of a current measurement. Because the current here also penetrates the cigarette paper, the electrical resistance thereof must be taken into account as an empirical value in the measurement so as to deduce the resistance and therefore the moisture of the tobacco in the cigarettes. Calibration measurements are necessary for this.

The apparatus described for determining the filling capacity of tobacco and the hardness of cigarettes are of largely the same construction. The same apparatus can therefore be used to drive the test plunger 8 or 108 and to acquire and process the measured values for the distance, force, temperature and moisture. To convert a functioning apparatus for determining the filling capacity of tobacco into a functioning apparatus for determining the hardness of cigarettes, it is only necessary for the test plunger 8 with the connecting rod 10 and the associated force-measurement device 12 including the measurement devices for temperature and moisture mounted on the test plunger 8 to be replaced by the test plunger 108 located on the test plunger carrier 110 with the measurement devices attached thereto for temperature and moisture and with the force-measurement devices 112A, 112B and 112C mounted on the intermediate piece 113. The sample holder 170 on the holding device 172 with the measurement devices for temperature and moisture which are situated thereon replaces the container 30 resting on the carriage 32 with the incorporated measurement devices for temperature and moisture.

In principle, the force-measurement devices 12 or 112A, 112B, 112C can also be fitted underneath the container 30, e.g. on the carriage 32, or on the sample holder 170 or the holding device 172 instead of on the test plungers 8 or 108.

In the following, the method for determining the filling capacity of tobacco is described which is implemented with the described apparatus for determining the filling capacity of tobacco. In the embodiment the measurements take place on cut tobacco; de-ribbed leaf tobacco or the complete leaves of a small-leafed type of tobacco can be used equally as well.

The control, data recording and data processing are carried out in the embodiment by two computers. The computer 44, called the auxiliary computer in the following, controls the stepping motor 18, through which the position of the test plunger 8 is known, and receives the measured values for the force exerted on the cut tobacco. This auxiliary computer communicates with a main computer, to which are connected the devices for the measurement of the temperature and moisture of the cut tobacco, and which also performs the further data evaluation. All the control, data-acquisition and evaluation processes can however be carried out equally as well by one single computer.

The length of the tobacco column between the lower edge 51 of the test plunger 8 and the upper edge 55 of the bottom of the container 30 is referred to in the following as the residual height RH. Here the upper edge 55 of the bottom indicates the zero point O for the position of the test plunger 8. By means of the set-up process described below for determining an initial position for the test plunger 8 in absolute length units, all values for the residual height RH are automatically related to the zero point O.

As a result of weight forces a force value is given on the force-measurement device 12 even when the plunger 8 is not under load. At the beginning of a test procedure for determining the filling capacity of cut tobacco, this offset value is automatically recorded and stored in the auxiliary computer. In all the following force measurements it is subtracted so that the measurement values given for the force F are zero-point adjusted.

The individual stages of the test procedure, i.e. the individual process stages for determining the filling capacity of cut tobacco, are explained below with reference to FIGS. 9 and 10.

At the start, all the devices are switched on and the programs for the main computer and the auxiliary computer are loaded. The slidable cross-piece 11 moves up to the limit switch 38, see FIG. 9(*a*). This top position is the starting position for the test plunger 8. The auxiliary computer then sends a signal BS1 to the main computer, which initiates the start of its program. The main computer then transmits parameters for the setting up and the test procedure to the auxiliary computer. These parameters indicate for example: the measurement range A of the force-measurement device 12, the height E of an adjustment gauge 68, the distance L between the upper edge 55 of the bottom of the container and the upper edge of the container 30, the setting G of the start position of the test plunger 8 relative to the zero point O, the time interval H between individual measurements during the relaxation period, the distance M between the lower edge 51 of the test plunger 8 and the upper edge 55 of the bottom of the container 30, with which data recording is started, the test velocity N at which the test plunger 8 is driven during the compression of the cut tobacco, the maximum force F(MAX), on reaching which the compression procedure is brought to an end and the test plunger 8 is stopped, the measurement interval P during the compression procedure, the relaxation period Q (in the order of minutes) and the setting V of the starting position of the test plunger 8 relative to the zero point 0.

Then an adjustment gauge 68, possibly a cylinder of known height E with a supporting edge, is set on the upper edge of the container 30 and the command is given to the main computer for the beginning of the adjustment, see FIG. 9(*b*). The main computer sends the command signal "a" to the auxiliary computer. Thereupon, the test plunger 8 is lowered to just before the adjustment gauge 68, and then the adjustment gauge 68 is pressed up to a pre-defined force, which is determined by means of the force-measurement device 12. The absolute value for this position of the test plunger 8 is L+E, see FIG. 9(*a*) and FIG. 9(*b*). Since this value is known, all future positions of the test plunger 8 can be determined by means of the number of steps covered by the stepping motor 18 (forwards or backwards), as already explained. Following this, the test plunger 8 is moved into the start position G and the auxiliary computer sends a signal BS2 to the main computer which indicates that the start position G has been reached. The apparatus is then ready to carry out measurements on the cut tobacco.

After the removal of the adjustment gauge 68 from the container 30, test-reference data and characteristic data for the cut tobacco of which the filling capacity is to be determined are entered into the main computer. The sample of cut tobacco is weighed (e.g. 400 g), the tobacco mass being received automatically by the main computer which is connected to the balance.

After this, the cut tobacco can be poured into the container 30. It is useful here that the container 30 can slide along the rails 34 on the carriage 32, the exact position relative to the test plunger 8 being defined by the stop pieces 36. After the user has input the start command to the main computer, the main computer transmits the control command "c" to the auxiliary computer, which thereupon first runs the test plunger 8 as far as position M, see FIG. 9(*c*). Recording the measured values for the force F and the residual height RH, which are stored in the auxiliary computer with the measurement interval P, i.e. in time intervals of P seconds, begins there. The test plunger 8 moves downwards at the constant test velocity N. As soon as the force F has reached the pre-set maximum value F(MAX), the test plunger 8 is stopped and the compression procedure is brought to an end. This is indicated to the main computer by the control signal BS4 transmitted by the auxiliary computer.

The test plunger 8 then rests at the final and minimum residual height RH=RHE, which is stored by the auxiliary computer, see FIG. 9(*d*). Now, during the relaxation period Q, a relaxation measurement is carried out for the cut tobacco R, the auxiliary computer receiving and storing the measured values for the force F with the interval H. At the same time, the main computer initiates the measurements of the temperatures $T_1$ and $T_2$ and the moisture-relevant voltage values U, and U:, as explained in the description of the apparatus for the determination of the filling capacity of tobacco. These values are sent to the main computer and stored there. After the end of the relaxation period Q, the auxiliary computer sends the control signal BS9 to the main computer, whereupon the latter sends the control signal "i" to the auxiliary computer. This causes the auxiliary computer to move the test plunger 8 back to its start position G. When start position G is reached, the auxiliary computer sends the control signal BS3 to the main computer.

The main computer then requests by means of the control signal "k" all the measured values of the test procedure from the auxiliary computer. The measured values are transmitted and stored in the format "force F, residual height RH, test range", with the parameter for the test range distinguishing between the values for the compression measurement and those for the relaxation measurement. The values for the force F are already adjusted to take account of the offset.

The main computer plots a compression curve and a relaxation curve for the tested cut tobacco from the measurement data it receives, from which curves values for the filling capacity can be deduced. In addition the main computer uses the data available to it for identification of the type of tobacco and the measured temperature and moisture to adjust the curves or filling-capacity values to reflect standard conditions. This is explained in more detail below.

During the calculations in the main computer and the output of the results, the test plunger 8 rests in the start position G. As soon as a new cut tobacco sample is poured into the container 30, another measurement to determine the filling capacity can begin. The subsequent test procedure is initiated by the user by means of a new command to the main computer, which thereupon transmits the control signal "c" to the auxiliary computer. A new adjustment for determining the absolute position of the test plunger 8 is not generally necessary. When there are critical error messages, however, the main computer sends the slidable cross-piece 11 back into the initial position, by means of the control signal "m", stopping it at limit switch 38. The control signal "m", is transmitted, for example, when the force received by the force-measurement device 12 exceeds a pre-set limit value or when switches of the unit's security devices are not closed. In these cases and basically when switching on the apparatus, adjustment by means of the adjustment gauge 68 must be repeated.

The calibration of the force-measurement device 12 should be checked at periodic intervals. To do this, a calibrated force-measurement hub 69 is used which is laid under the test plunger 8 in place of the container 30, see FIG. 10. The height C of the force-measurement hub 69 above the zero point 0 and the start position G' for calibration measurements are transmitted as parameters from the main computer to the auxiliary computer. For calibration the test plunger moves starting from the start position G' at minimum velocity on to the force-measurement hub 69. Following this, the measured values for the force obtained via the force-measurement device 12 can be compared with those of the calibrated force-measurement hub 69, so as to correct if necessary the values obtained from the force-measurement device 12.

After the end of a complete test procedure for measuring filling-capacity relevant data of a given cut tobacco sample, the following measured values are available to the main computer:

The compression measurement data pairs (force F, residual height RH, the velocity N of the test plunger 8 being constant), the relaxation measurement data pairs (force F, time $t_r$, the measured residual height RH=RHE being constant), the mass m of the cut tobacco (about 400 g for a volume of the container 30 of approximately 5 liters), the measured temperature values $T_1$, $T_2$ and their average value T, and the voltage values $U_1$, $U_2$ of the conductivity measurement and their average value U.

From the data obtained during the compression and relaxation measurements, general tobacco-elastic characteristic values can be calculated or empirically estimated, e.g. the compressibility or the solid/fluid behavior of the cut tobacco. These characteristic values depend on the one hand on the tobacco blend and on the other are greatly dependent on the temperature and tobacco moisture.

A compression curve can be plotted from the compression measurement data pairs, see FIG. 11. Here the force F acting on the tobacco is plotted as a function of the residual height RH. The residual height RH decreases from left to right. Because in the embodiment the test plunger 8 is driven at a constant velocity N, there is a linear relationship between the residual height RH and the time $t_k$ elapsed during the compression of the cut tobacco; the time $t_k$ increases from left to right. The curve in FIG. 11 ends at the maximum force F(MAX). The residual height RH1 for a defined test force Fl can be designated the "filling capacity" FF of the cut tobacco, see FIG. 11.

In FIG. 12 the force F determined during the relaxation measurement is plotted as a function of time $t_r$ for two different tobacco types. The force F decreases continuously from its maximum value F(MAX) at time $t_r=0$, until the measurement is ended following the expiry of the relaxation period at time Q. The curves plotted in FIG. 12 represent the solid/fluid behavior of the two tobacco types tested.

In order to be able to compare the results of different measurements, they must be adjusted to reflect standard conditions. The following can for example be standard conditions: 400 g tobacco mass, a temperature of 22° C. and a tobacco moisture of 12% (relative to total substance). The adjustments can be carried out after the end of the relaxation measurement in the main computer as explained below, so that after a measurement the adjusted filling capacity value can already be output.

The adjustment steps listed below are all based on known empirical relationships. Empirical coefficients are used in calculating them, specific to the tested tobacco blend. These correction coefficients are stored in the main computer.

From the unadjusted data plotted as in FIG. 11, the filling capacity FF(0) (corresponds to RH1) is obtained, for example, by means of a spline interpolation, for a given mass, moisture and temperature of the cut tobacco.

First, by normalizing to the weighed tobacco mass, a mass adjustment is carried out, which produces an adjusted filling capacity value FF(1).

The measured value U for the voltage is directly dependent on the temperature T. This is to be taken into account when the actual moisture WG of the tobacco is being calculated using U.

The filling capacity at a given moisture also depends directly on the temperature T. Using the blend-dependent equation FF=f(T) the filling capacity FF(1) can be converted into the filling capacity value FF(2) at 22° C. and the given moisture WG of the tobacco. Another equation allows finally the conversion of FF(2) into FF(3) using the actual moisture WG, FF(3) being the filling capacity value adjusted to reflect a tobacco moisture of 12% and therefore the value adjusted fully to reflect standard conditions for the filling capacity of the tested type of tobacco.

The method for determining the hardness of cigarettes is carried out in practically the same way as the method for determining the filling capacity of tobacco. Even the same computer programs can be used. Only the values for some of the parameters entered into the main computer are different. For example, an adjustment gauge of height E is laid directly on the sample holder 170, so that L=0. The zero point 0 is defined by the surface of the sample holder 170 in the middle regions 178 of the recesses 176 for the cigarettes Z. The residual height RH now corresponds to the "residual thickness" of the cigarettes; it is determined by the distance between the surface of the sample holder 170 in the middle regions 178 and the pressure surface 109 of the test plunger 108. Since in the embodiment three force-measurement devices 112A, 112B and 112C are used, the total force F exerted on the cigarettes equals the sum of the offset-adjusted forces which are read by the three force-measurement devices 112A, 112B, 112C.

FIG. 13 shows a compression curve measured on cigarettes. The hardness value HA of the cigarettes can be defined as the "penetration depth" using two residual heights RH1 and RH2 occurring for defined forces F1 and F2:

$$HA = RH1 - RH2.$$

It is equally possible to give a percentage "deformation" HA (%):

$$HA(\%) = 100 * RH2 / RH1.$$

The force F1 defining the first position should be chosen to be as small as possible.

FIG. 12 shows two relaxation curves measured on cigarettes. They are similar in shape to the relaxation curves of cut tobacco.

The hardness values are again specific to the blend dependent on the parameters of temperature, tobacco moisture and tobacco weight per cigarette. The hardness values, just like the filling capacity values for cut tobacco, can be adjusted by means of empirical equations to reflect standard conditions; in this case additionally the empirically known properties of the cigarette paper have to be taken into account, in order to derive from the moisture-relevant measurement values the moisture of the tobacco contained in the cigarette.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for determining the hardness of cigarettes wherein a force is exerted on a predetermined number of cigarettes disposed on a substantially flat sample holder by a test plunger movable toward the cigarettes on said sample holder, and wherein the thickness of the cigarettes under the action of the force and its elapsed time are measured, said method comprising the steps of:

compressing the cigarettes on the sample holder by moving the plunger toward said sample holder;

measuring the force exerted on the cigarettes and providing an output signal in response thereto;

measuring the thickness of the cigarettes by measuring the distance moved by said test plunger and providing an output signal in response thereto;

after the end of the compression movement of said test plunger when it rests in its end position for a relaxation period, measuring the force acting on the cigarettes at preset time intervals and providing an output signal responsive thereto;

independently measuring a parameter indicative of the hardness of the cigarettes and providing an output signal in response thereto; and processing said signals by computer to determine the hardness of the cigarettes, the step of processing said signals including processing the signals derived from measuring the force acting on the cigarettes during the relaxation period.

2. A method for determining the hardness of cigarettes wherein a force is exerted on a predetermined number of cigarettes disposed on a substantially flat sample holder by a test plunger movable toward the cigarettes on said sample holder, and wherein the thickness of the cigarettes under the action of the force and its elapsed time are measured, said method comprising the steps of:

compressing the cigarettes on the sample holder by moving the plunger toward said sample holder;

measuring the force exerted on the cigarettes and providing an output signal in response thereto;

measuring the thickness of the cigarettes by measuring the distance moved by said test plunger and providing an output signal in response thereto;

independently measuring a parameter indicative of the hardness of the cigarettes, including measuring the temperature of the cigarettes during or immediately after the cigarettes are compressed, and providing an output signal in response thereto; and processing said signals by computer to determine the hardness of the cigarettes.

3. A method for determining the hardness of cigarettes wherein a force is exerted on a predetermined number of cigarettes disposed on a substantially flat sample holder by a test plunger movable toward the cigarettes on said sample holder, and wherein the thickness of the cigarettes under the action of the force and its elapsed time are measured, said method comprising the steps of:

compressing the cigarettes on the sample holder by moving a plunger toward said sample holder;

measuring the force exerted on the cigarettes and providing an output signal in response thereto;

measuring the thickness of the cigarettes by measuring the distance moved by said test plunger and providing an output signal in response thereto;

independently measuring a parameter indicative of the hardness of the cigarettes, including measuring the moisture content of the cigarettes during or immediately after the cigarettes are compressed, and providing an output signal in response thereto; and processing said signals by computer to determine the hardness of the cigarettes.

4. Apparatus for determining the hardness of cigarettes, comprising:

a substantially flat sample holder for holding the cigarettes;

a test plunger mounted for movement toward and away from the surface of said sample holder to exert a force on the cigarettes, said test plunger having a pressure surface extending substantially parallel to the surface of said sample holder;

means for measuring the force exerted on the cigarettes and providing an output signal responsive thereto;

a distance measurement device for determination of the thickness of the cigarettes situated between said pressure surface of said test plunger and the surface of said sample holder and providing an output signal in response thereto;

a drive device including a motor for driving said test plunger;

measurement devices on said sample holder or said test plunger for determining the temperature of the cigarettes and providing an output signal in response thereto;

a computer;

means coupling said computer and said drive motor for driving said test plunger;

said computer being responsive to said signals including said temperature signal for determining the hardness of the cigarettes.

5. Apparatus for determining the hardness of cigarettes, comprising:

a substantially flat sample holder for holding the cigarettes;

a test plunger mounted for movement toward and away from the surface of said sample holder to exert a force on the cigarettes, said test plunger having a pressure surface extending substantially parallel to the surface of said sample holder;

means for measuring the force exerted on the cigarettes and providing an output signal responsive thereto;

a distance measurement device for determination of the thickness of the cigarettes situated between said pressure surface of said test plunger and the surface of said sample holder and providing an output signal in response thereto;

a drive device including a motor for driving said test plunger;

measurement devices on said sample holder or on said test plunger for determining the moisture content of the cigarettes and providing an output signal in response thereto;

a computer;

means coupling said computer and said drive motor for driving said test plunger;

said computer being responsive to said signals including said moisture content signal for determining the hardness of the cigarettes.

6. Apparatus for determining the hardness of cigarettes, comprising:

a substantially flat sample holder for holding the cigarettes, said sample holder having a plurality of radially arranged recesses having approximately the length of a cigarette, said sample holder having plane center regions, said recesses being delimited at each of their opposite ends from the respective neighboring recesses by ridges;

a test plunger mounted for movement toward and away from the surface of said sample holder to exert a force on the cigarettes, said test plunger having an annular shape and having a pressure surface extending substantially parallel to the surface of said sample holder, said test plunger having plane center regions;

means for measuring the force exerted on the cigarettes and providing an output signal responsive thereto;

a distance measurement device for the determination of the thickness of the cigarettes situated between said pressure surface of said test plunger and the surface of said sample holder and providing an output signal in response thereto;

a drive device including a motor for driving said test plunger;

a computer;

means coupling said computer and said drive motor for driving said test plunger;

said computer being responsive to said signals for determining the hardness of the cigarettes.

7. Apparatus according to claim 6 wherein said annular test plunger is mounted for removal from said apparatus, a second ring disposable in said apparatus in lieu of said test plunger and situate opposite the region of the filters of the cigarettes lying on the sample holder, said second ring being useful for the determination of the hardness of the filters.

8. A method for determining a tobacco hardness-related parameter wherein a force is exerted on tobacco disposed on a sample holder by a test plunger movable toward the tobacco on said sample holder, and wherein the thickness of the tobacco under the action of the force and the elapsed time are measured, said method comprising the steps of:

compressing the tobacco on said sample holder by moving said test plunger toward said sample holder;

measuring the force exerted on the tobacco and providing an output signal in response thereto;

measuring the thickness of the tobacco by measuring the distance moved by said test plunger and providing an output signal in response thereto;

independently measuring another parameter indicative of said tobacco hardness-related parameter and providing an output signal in response thereto;

processing said signals by computer to determine said tobacco hardness-related parameter; and after the end of the compression movement of said test plunger when it rests in its end position for a relaxation period, measuring the force acting on the tobacco at preset time intervals and providing an output signal responsive thereto, the step of processing said signals, including processing the signals derived from measuring the force acting on the tobacco during the relaxation period.

9. A method according to claim 8 wherein the hardness-related parameter is the filling capacity of tobacco and the sample holder comprises a container closed on one side by the movable test plunger, the steps of compressing and measuring being performed on the tobacco within the container and the signals processed by the computer determining the filling capacity of the tobacco.

10. A method for determining a tobacco hardness-related parameter wherein a force is exerted on tobacco disposed on a sample holder by a test plunger movable toward the tobacco on said sample holder, and wherein the thickness of the tobacco under the action of the force and the elapsed time are measured, said method comprising the steps of:

compressing the tobacco on said sample holder by moving said test plunger toward said sample holder;

measuring the force exerted on the tobacco and providing an output signal in response thereto;

measuring the thickness of the tobacco by measuring the distance moved by said test plunger and providing an output signal in response thereto;

independently measuring another parameter indicative of said tobacco hardness-related parameter and providing an output signal in response thereto;

processing said signals by computer to determined said tobacco hardness-related parameter; and independently measuring another parameter including measuring the temperature of the tobacco during or immediately after the tobacco are compressed.

11. A method according to claim 10 wherein the hardness-related parameter is the filling capacity of tobacco and the sample holder comprises a container closed on one side by the movable test plunger, the steps of compressing and measuring being performed on the tobacco within the container and the signals processed by the computer determining the filling capacity of the tobacco.

12. A method for determining a tobacco hardness-related parameter wherein a force is exerted on tobacco disposed on a sample holder by a test plunger movable toward the tobacco on said sample holder, and wherein the thickness of the tobacco under the action of the force and the elapsed time are measured, said method comprising the steps of:

compressing the tobacco on said sample holder by moving said test plunger toward said sample holder;

measuring the force exerted on the tobacco and providing an output signal in response thereto;

measuring the thickness of the tobacco by measuring the distance moved by said test plunger and providing an output signal in response thereto;

independently measuring another parameter indicative of said tobacco hardness-related parameter and providing an output signal in response thereto;

processing said signals by computer to determine said tobacco hardness-related parameter; and independently measuring another parameter including measuring the moisture content of the tobacco during or immediately after the tobacco are compressed.

13. A method according to claim 12 wherein the hardness-related parameter is the filling capacity of tobacco and the sample holder comprises a container closed on one side by the movable test plunger, the steps of compressing and measuring being performed on the tobacco within the container and the signals processed by the computer determining the filling capacity of the tobacco.

14. Apparatus for determining a tobacco hardness-related parameter, comprising:

a sample holder for holding tobacco;

a test plunger mounted for movement toward and away from said sample holder to exert a force on the tobacco;

means for measuring the force exerted on the tobacco and providing an output signal responsive thereto;

a distance measurement device for the determination of the thickness of the tobacco situated between said test plunger and said sample holder and providing an output signal in response thereto;

measurement devices on said sample holder or said test plunger for determining the temperature of the tobacco and providing an output signal in response thereto;

a drive device including a motor for driving said test plunger;

a computer; and means coupling said computer and said drive motor for driving said test plunger;

said computer being responsive to said force, distance and temperature measurement signals for determining the tobacco hardness-related parameter.

15. Apparatus according to claim 14 wherein said sample holder comprises a container open on one end for holding the tobacco, said test plunger being movable toward and into said container to close the latter and exert a force on the tobacco, said computer being responsive to said signals for determining the filling capacity of the tobacco.

16. Apparatus for determining a tobacco hardness-related parameter, comprising:

a sample holder for holding tobacco;

a test plunger mounted for movement toward and away from said sample holder to exert a force on the tobacco;

means for measuring the force exerted on the tobacco and providing an output signal responsive thereto;

a distance measurement device for the determination of the thickness of the tobacco situated between said test plunger and said sample holder and providing an output signal in response thereto;

measurement devices on said sample holder or on said test plunger for determining the moisture content of the tobacco and providing an output signal in response thereto;

a drive device including a motor for driving said test plunger;

a computer;

means coupling said computer and said drive motor for driving said test plunger;

said computer being responsive to said force, distance and moisture measurement signals for determining the tobacco hardness-related parameter.

17. Apparatus according to claim 16 wherein said sample holder comprises a container open on one end for holding the tobacco, said test plunger being movable toward and into said container to close the latter and exert a force on the tobacco, said computer being responsive to said signals for determining the filling capacity of the tobacco.

* * * * *